US007179210B2

(12) United States Patent
Soukeras

(10) Patent No.: US 7,179,210 B2
(45) Date of Patent: Feb. 20, 2007

(54) CLUB-WEIGHT(S)

(76) Inventor: John E. Soukeras, P.O. Box 9875, Newport Beach, CA (US) 92658

( * ) Notice: Subject to any disclaimer, the term of this patent is extended or adjusted under 35 U.S.C. 154(b) by 114 days.

(21) Appl. No.: 10/772,596

(22) Filed: Feb. 6, 2004

(65) Prior Publication Data

US 2005/0176561 A1 Aug. 11, 2005

(51) Int. Cl.
*A63B 15/00* (2006.01)
*A63B 21/22* (2006.01)
*A63D 9/00* (2006.01)

(52) U.S. Cl. ..... 482/109; 473/118; 482/110

(58) Field of Classification Search ..... 482/109, 482/82; 206/443
See application file for complete search history.

(56) References Cited

U.S. PATENT DOCUMENTS 257,929 A * 5/1882 Polk ..... 482/109
275,627 A * 4/1883 Foster et al. ..... 482/109
295,429 A * 3/1884 Reach ..... 482/109
596,543 A * 1/1898 Randall ..... 482/109
4,061,226 A * 12/1977 Essen ..... 206/306
4,279,416 A * 7/1981 Finnigan, III ..... 482/109
5,330,193 A * 7/1994 Ijiri ..... 473/256
5,484,361 A * 1/1996 Dunn ..... 482/51
5,979,649 A * 11/1999 Rosler ..... 206/379
6,183,829 B1 * 2/2001 Daecher et al. ..... 428/64.1
6,228,002 B1 * 5/2001 Dantolan ..... 482/93
6,752,746 B1 * 6/2004 Winkler et al. ..... 482/82

FOREIGN PATENT DOCUMENTS

JP 10219978 A * 8/1998

* cited by examiner

*Primary Examiner*—Stephen R. Crow
*Assistant Examiner*—Arun Chhabra

(57) ABSTRACT

This invention is an exercise club, which may be held comfortable in one hand. Two of these clubs may be used, one in each hand, to execute a series of planned movements, which result in a full body workout. The weight of the clubs may be easily adjusted, to alter the intensity of the workout as desired. Virtually any person can use the clubs to improve their strength, health and fitness. This club can be made preferably of enforced polypropylene for rapid and quick volume production through injection molding.

3 Claims, 8 Drawing Sheets

CLUB-WEIGHT(S)

FIELD OF THE INVENTION

This invention is in the field of exercise, fitness, body strength, and health.

BACKGROUND OF THE INVENTION

In order to fully exercise the body, a person must often obtain a set of exercise equipment, the components of which are designed to exercise each part of the body separately. As a result, one part of the body is often exercised more than the rest, so that a uniform benefit is not achieved.

For example, dumbbells of varying weights are commonly used for exercising the arms and shoulders, but cannot be used effectively for exercising the wrists and fingers. In addition, small dumbbells must be used for exercising weaker muscles, and larger dumbbells must be used for exercising stronger muscles, such as the biceps. Some dumbbells, such as those disclosed in U.S. Pat. Nos. 4,695,051, 4,913,422, and 4,854,575, are filled with a liquid or other heavy substance such as sand, to allow adjustment of the weight of the dumbbell for exercising different muscles. However, modifying the weight of these devices is a cumbersome process.

A number of complex, multicomponent exercise devices have been recently advertised for exercising parts of the body such as the legs, thighs, and chest. These devices typically incorporate sliding or scissored arms biased by springs, elastic bands or pneumatic cylinders to provide an opposing force against the user. These devices are commonly expensive, difficult to use and have the particular disadvantage of exercising at most two or three parts of the body.

The technical literature regarding exercising has stressed the importance of a "full body" workout. It has been recognized that selectively training certain parts of the body at the expense of others can lead to health problems in those parts of the body that are not exercised. Furthermore, neglect of certain muscle groups can lead to balance problems and an overall loss of athletic performance. In particular, this need for a full body workout has led to the recent trend of "cross-training," i.e., training in several sports simultaneously so as to exercise all parts of the body.

Cross training, however, can be very expensive, for the simple reason that athletic gear and equipment is required for each of the several individual sports or exercises in which the athlete attempts to engage.

SUMMARY OF THE INVENTION

This invention is a novel club for exercising, which may be held comfortably in one hand. Two of these clubs may be used, one in each hand, to execute a series of planned movements, which result in a full body workout. The clubs' weight can be easily adjusted to provide a lighter of heavier workout, as desired. Virtually any person, regardless of age, size, weight, sex or level of physical fitness can use these clubs to improve their strength, health, and fitness.

An exercise club formed in accordance with the present invention has a main body and a handle, and the main body has a hollow core, which is open at one end. Within the hollow care may be placed one or more weight tubes to alter the overall weight of the club. If there is a plurality of weight tubes, they are sized so that they may be placed one inside the other within the hollow core. An end cap is provided to close the open end of the club and safely retain the weight tubes within the hollow core. Because the club carries the weight tubes within the hollow core, its weight can be easily adjusted without changing the outer shape of the club.

The tube-in-tube design is preferred because it prevents the tubes from rattling against one another within the club. In addition, unused tubes can be conveniently stacked within each other, requiring little storage space. In this manner, the user can easily carry and store the tubes in a handbag or gym bag when they are not in use.

I also describe a method for using the clubs, comprising a sequence of exercise movements, which are to be performed while holding the clubs, one in each hand. Together with the weighted clubs, these coordinated movements work the two arms in opposite synchronicity, creating a gyrating effect on the body, which tends to dislocate the feet from the floor. The body's natural reaction—to attempt to remain in position—causes nearly all of the muscles of the body to work in unison to balance the body. The result is a very good workout, exercising all the muscles of the body. In addition, because the exercise is aerobic and requires a high degree of endurance, these movements exercise and increase the capacity of the heart and lungs. Moreover, because the clubs' weight is adjustable, a person using the clubs can easily control the intensity of the exercise.

BRIEF DESCRIPTION OF THE DRAWINGS

FIGS. 3, 4, 5, 8A and 8B are cross-sectional views of the invention.

Referring to FIGS. 1, 2, 3 and 4, the club has a handle #11, and a main body. The main' body has a hollow core, FIG. 3, #10, in which the cylindrical weights, FIG. 1, #14, are inserted one inside the other, to increase or decrease the weight of the club. In order to retain minimum thickness of all the walls of the club, for quick cure after the injection molding, ribs are designed FIGS. 1, 2, 3 and 4, #13 and FIGS. 5, 6, 7 and 8, #15 as a part of the body and cup. Ribs and all parts of the club are no more than 2 mm. thick. A cover, item #16, FIGS. 7, 8A and 8B, may be fitted over the opening at the top of the hollow core to secure the inserted cylinders in place. The cover, item #16, FIGS. 7, 8A and 8B, may be threaded onto the main body as shown in FIGS. 3, 4 and 5 or held in place by an interference fit. The cover #16 may alternatively be attached by such other mechanical or adhesive means as are known in the art. The cover #16 is preferably shaped to form the complete club, FIGS. 1 and 2. When in place the cover #16 and main body, FIG. 6, appear to form a single unit. Advantageously, the cover #16 may be cupped or bored on its inside surface so that the cylinders FIG. 1 #14, extend partly into the cover #16 when the cover #16 is in the closed position. In this manner, the cylinders may be made slightly longer, and therefore heavier, giving the club a greater range of overall weight.

Figure 1:
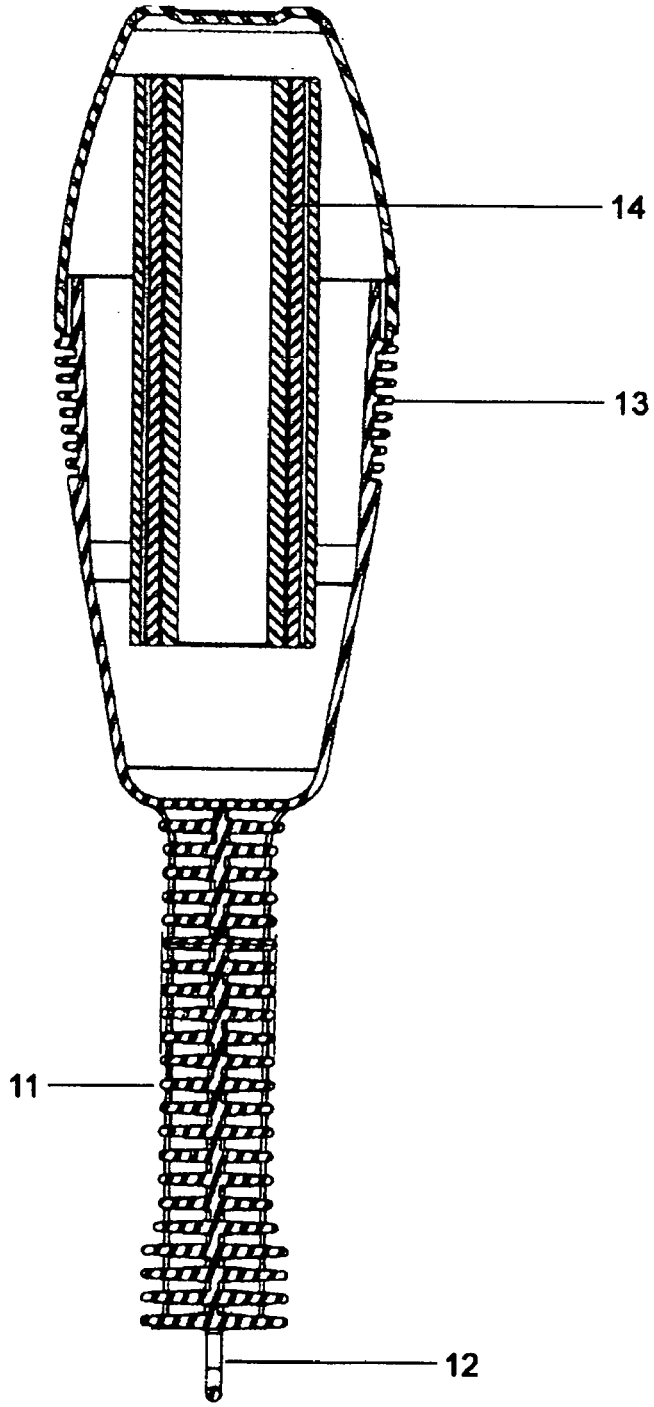
FIGS. 1, 2, 3, 4 and 7 are exterior and cross-sectional views of the invention.
Figure 2:
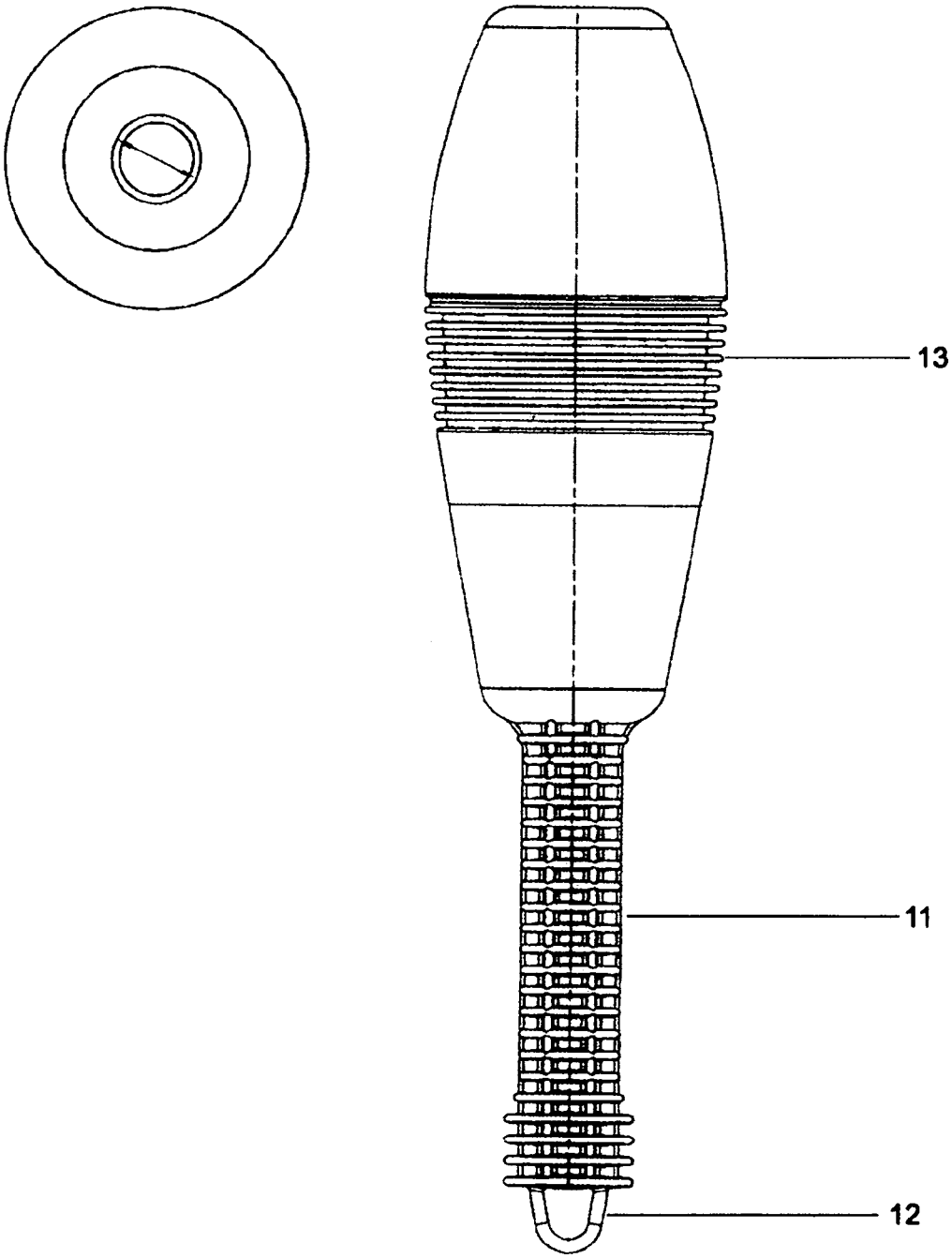
Figure 3:
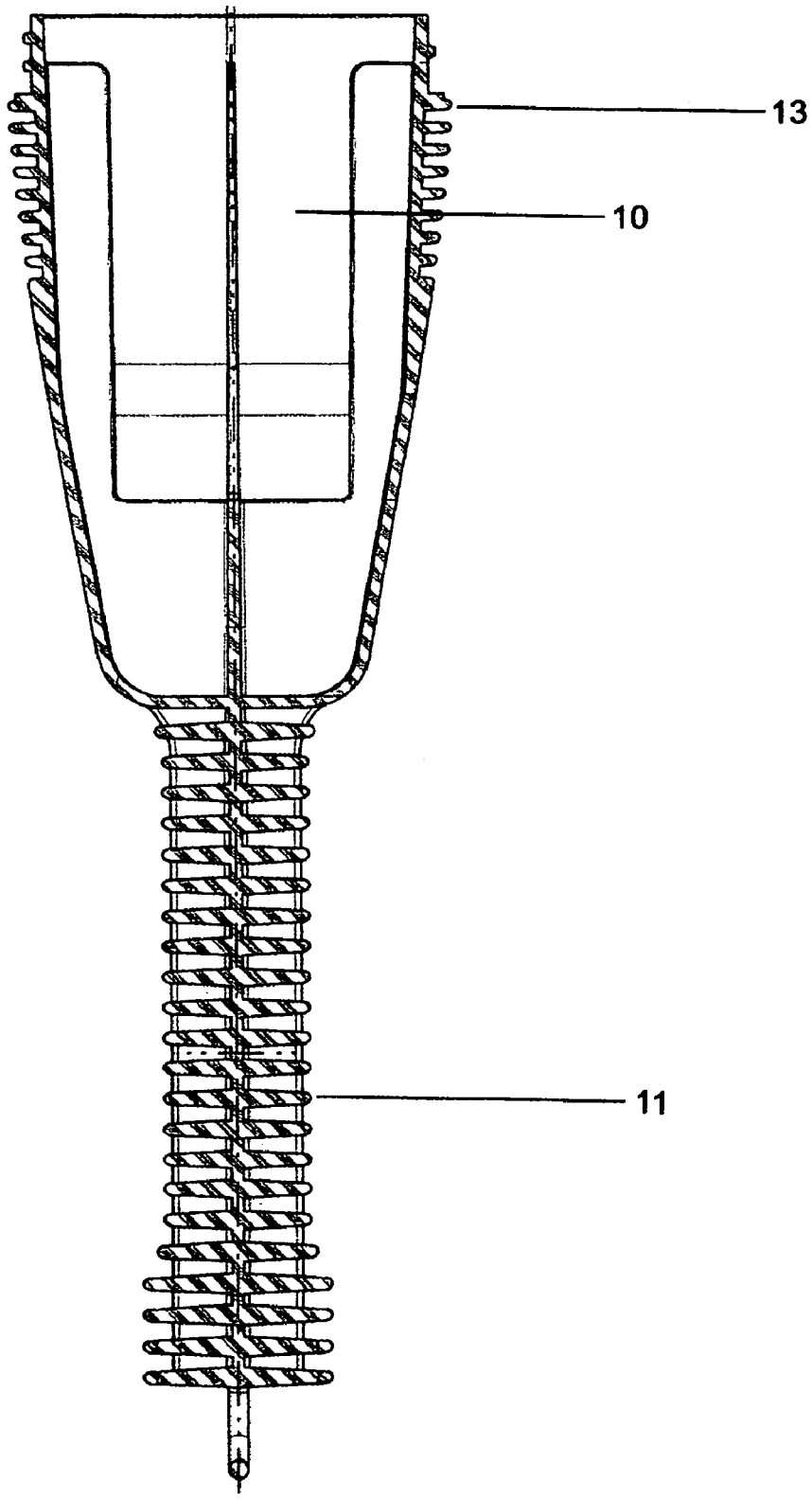
Figure 4:
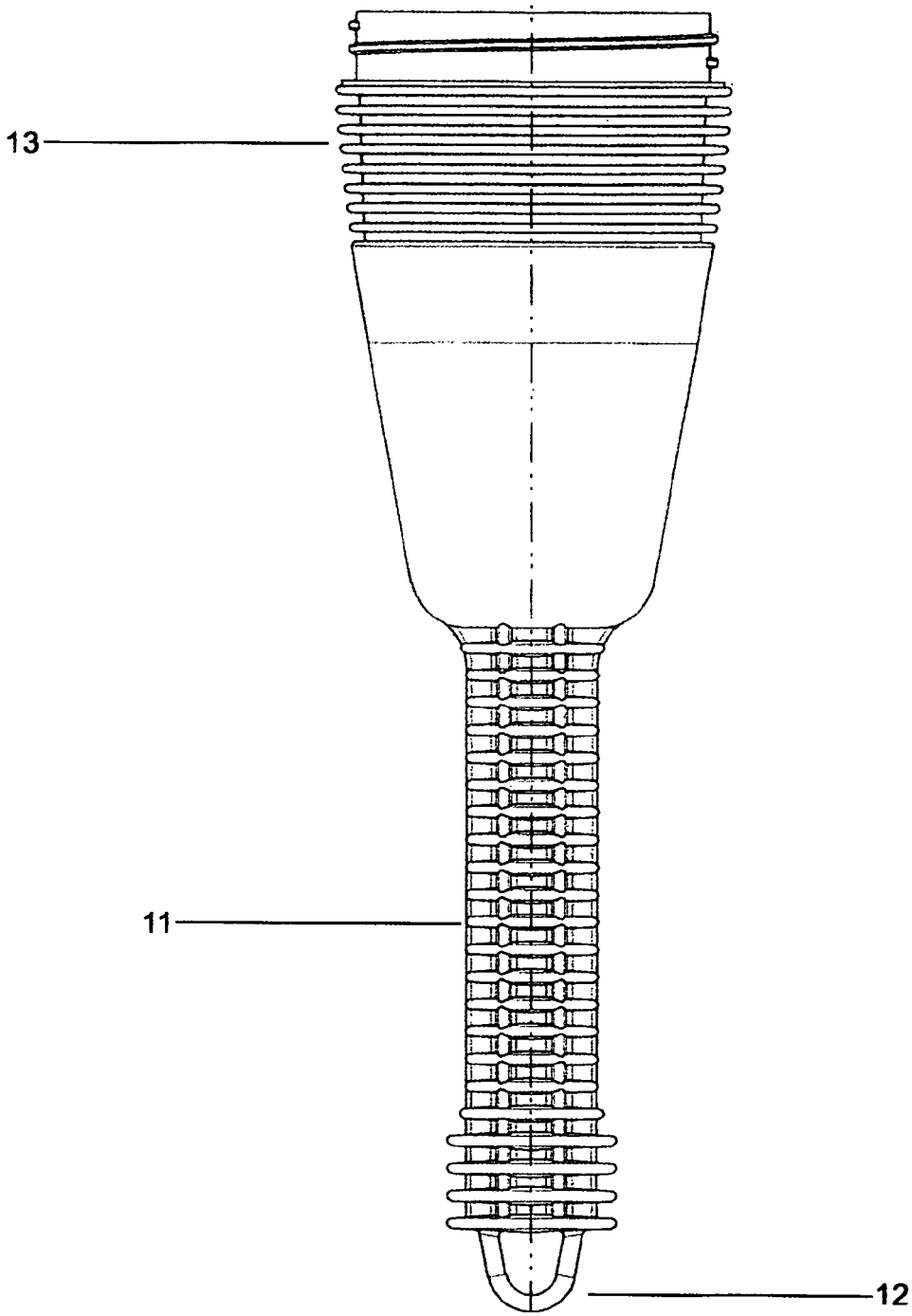
Figure 5:
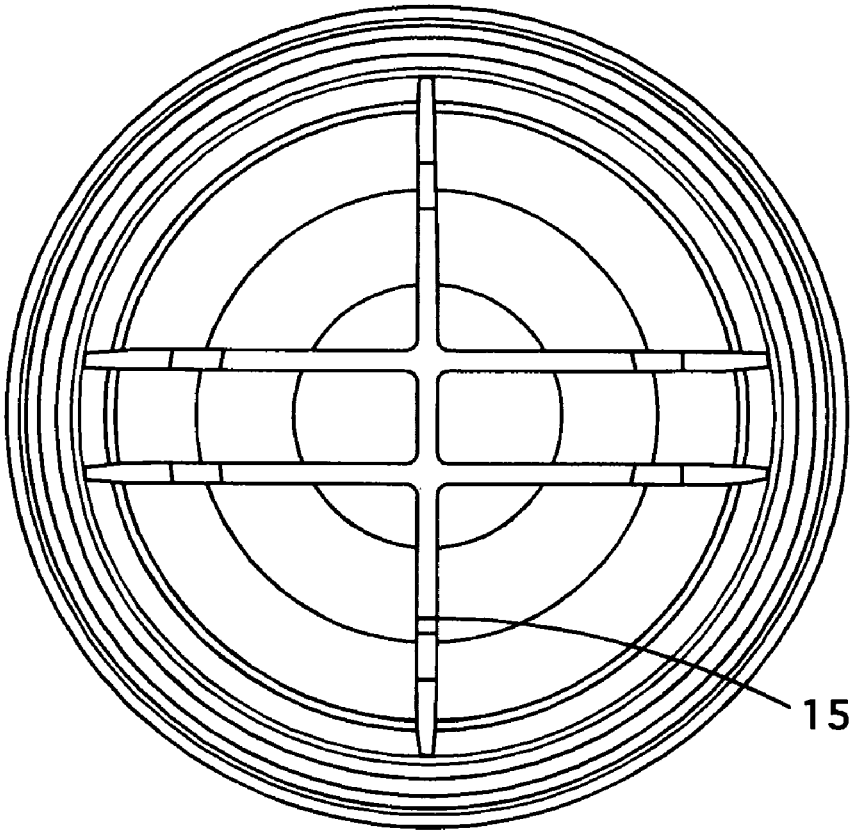
Figure 6:
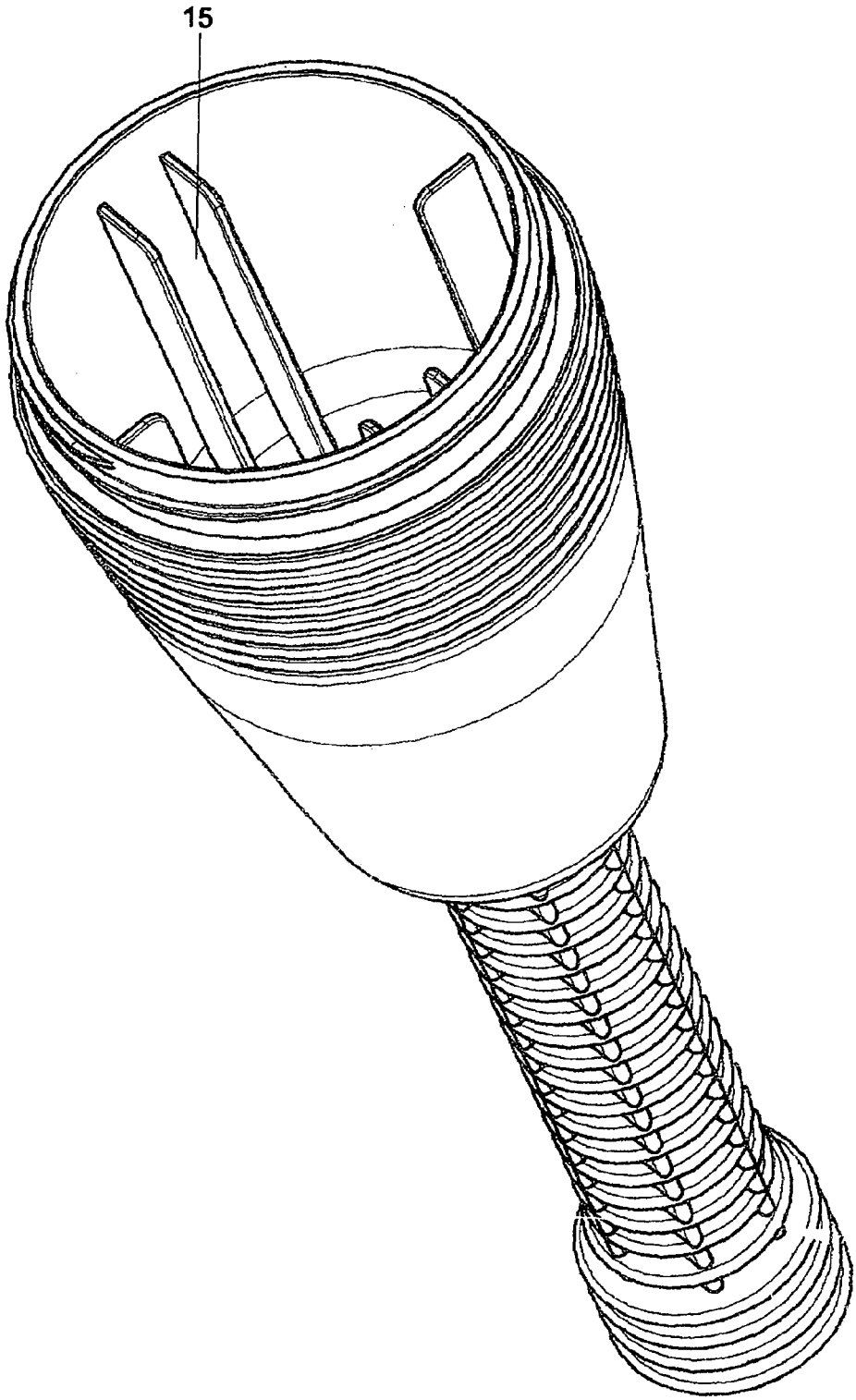

In size, the club is approximately 45 cm. long, from the tip of the handle, FIGS. 1, 2, 3 and 4, #11, to the end of the cover #16. The main body is approximately 10 cm in diameter at its widest point, and gently slopes as shown in FIGS. 3 and 4 to a narrower diameter of approximately 5 cm. towards the cover #16 and the handle, #11. The diameter of the handle #11, is such that it is easily gripped by the hand of an average user, and is about 2.5 cm. in diameter, and 15 cm long. Of course, the club may be manufactured in a variety of sizes, to accommodate users ranging from small children to adults. There is also a loop, FIGS. 1 and 2, #12, at the end of the handle to insert a strap in order to secure the club by the wrist.

Tubes may be coated with a soft rubber or similar cushioning layer (not shown) to promote a snug fit.

The end of the handle #11 is preferably, slightly larger in diameter, to prevent the club from slipping from the hand of the user during exercising. It is preferably formed integrally with the handle.

Figure 7:
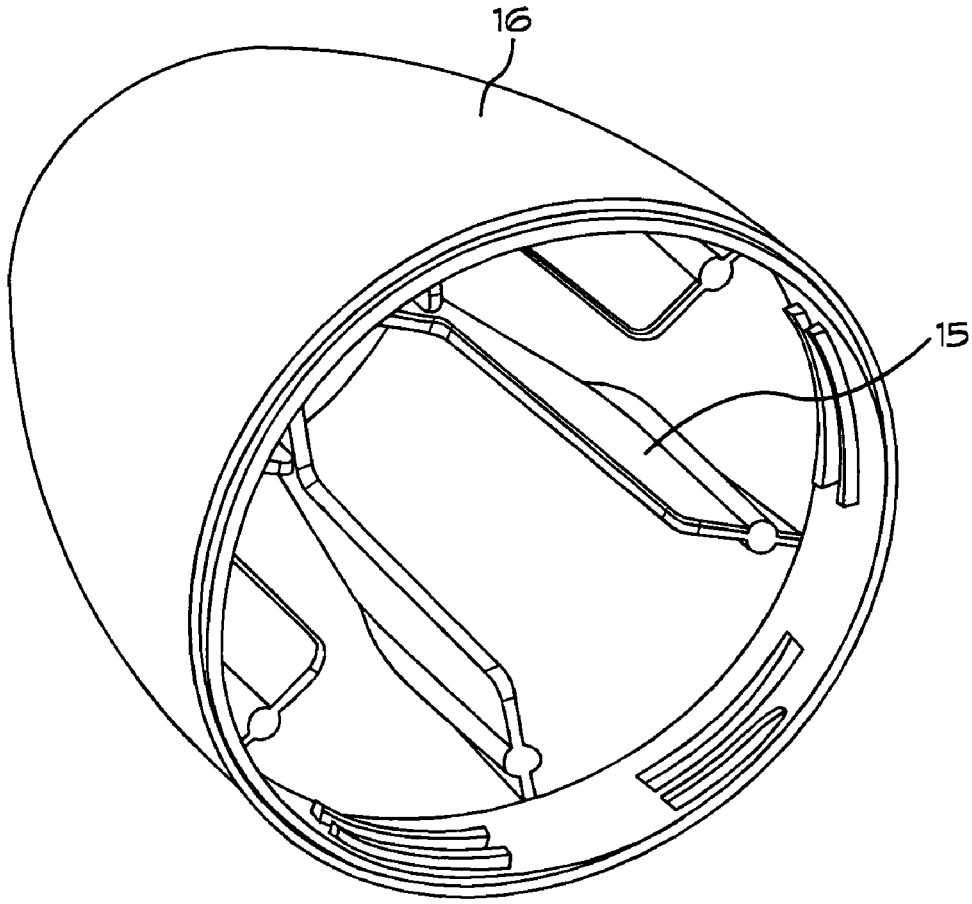

The club, FIGS. 1 and 2, including the handle #11, and cover FIG. 7, #16, should be made of a rigid, durable material, preferably enforced polypropylene. The exterior of the club may be painted of decorated with colors or designs to make it attractive and pleasing to the eye.

It will be appreciated that cylinders and end cap provide a means for creating a club of different weights. The adjustable weight of the club may be suitable for those users whose wrists or forearms are weak or damaged, such as users suffering from broken or strained wrists, or carpal tunnel syndrome. In contrast, a heavier club composed of several cylinders, will exert more torque on the wrist, providing the means for greater exercising of the wrist and forearm.

Figure 8A:
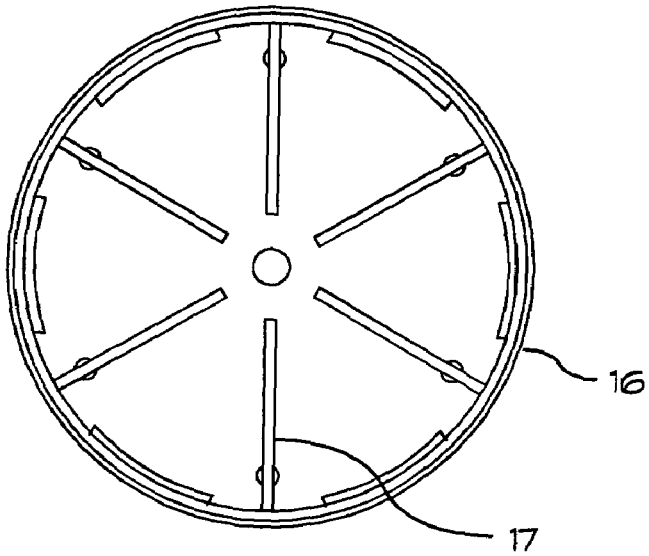
Figure 8B:
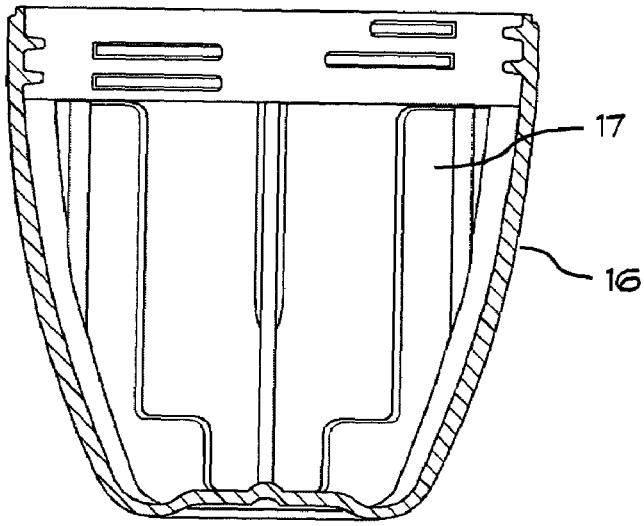

As shown in FIGS. 7 and 8, the end cap 16 has a plurality or inwardly facing ribs 17 that form a portion of the receptacle for receiving the weights.

What is claimed is:

1. An exercise club for aiding a user in performance of a variety of exercises, comprising:

a handle formed to have a generally elongate configuration, the handle having a first end and a second end, the handle being further formed to have a diameter near the first end such that it can be gripped by the user;

a main body connected to the handle and arranged to extend lengthwise from the second end thereof, the main body being formed to have a cavity therein that has an open end and a closed end such that the cavity has a side wall and a bottom, the cavity being formed to receive a weight therein; and a first plurality of ribs extending from the side wall toward a central region of the cavity such that the first plurality of ribs have inner edge portions that form a receptacle for retaining the weight in a selected position in the cavity;

an end cap arranged for attachment to the open end of the main body to retain the weight within the cavity, the end cap including a recess therein, the weight being formed to have a length such that it extends from the bottom of the cavity into the recess in the end cap, the end cap further including a plurality of ribs that extend radially between perimeter portions of the end cap and selected locations inside the end cap so that the plurality of ribs can be aligned and continuous with the first plurality of ribs of the main body to form one continuous rib extending down the length of the exercise club, the end cap forming a retainer for securing a lower end portion of a weight placed in the cavity against movement relative to the end cap so that the lower end portion of the weight is centered within the end cap, the end cap being formed to be removable from the main body so that the user may place one or more of a plurality of weights in the cavity.

2. The exercise club of claim 1 wherein the main body comprises:

a hollow generally frustoconical section having a smaller diameter end connected to the handle and forming the bottom of the cavity and the generally frustoconical section having a larger diameter end extending away from the handle; and a hollow generally cylindrical section extending from the larger diameter end of the generally frustoconical section, the first plurality of ribs being formed to extend from near the open end to the second plurality of ribs, the first plurality of ribs being arranged to snugly fit with the weight.

3. The exercise club of claim 1 wherein the weight comprises a plurality of elongate concentric cylinders.

* * * * *